US005579629A

United States Patent [19]

Fischer

[11] Patent Number: 5,579,629

[45] Date of Patent: Dec. 3, 1996

[54] METHOD OF PRODUCING A FRICTION TEXTURIZED POLYESTER FILAMENT YARN AND YARN MADE THEREBY

[75] Inventor: Klaus Fischer, Lucetne, Switzerland

[73] Assignee: Rhone-Poulenc Viscosuisse S.A., Emmenbruecke, Switzerland

[21] Appl. No.: 47,794

[22] Filed: Apr. 15, 1993

Related U.S. Application Data

[63] Continuation-in-part of Ser. No. 613,776, Nov. 16, 1990, abandoned.

[30] Foreign Application Priority Data

Mar. 23, 1989 [CH] Switzerland ..... 01095/89

[51] Int. Cl.[6] ..... D02G 3/00; D02G 3/36

[52] U.S. Cl. ..... 57/284; 57/205; 57/247; 57/351

[58] Field of Search ..... 57/284, 289, 208, 57/245, 247, 908, 351, 205, 246

[56] References Cited

U.S. PATENT DOCUMENTS

| | | | |
|---|---|---|---|
| 3,488,941 | 1/1970 | Asaka | 57/284 |
| 4,070,815 | 1/1978 | Megishi et al. | 57/208 |
| 4,170,867 | 10/1979 | Leininger | 57/245 |
| 4,219,997 | 9/1980 | Hatcher | 57/290 X |
| 4,244,171 | 1/1981 | Sasaki et al. | 57/208 |
| 4,334,401 | 6/1982 | Bahia | 57/209 X |
| 4,365,466 | 12/1982 | Horiuchi et al. | 57/245 X |
| 4,370,853 | 2/1983 | Bauer et al. | 57/340 |
| 4,464,894 | 8/1984 | Leininger | 57/288 |
| 4,467,594 | 8/1984 | Eschenbach | 57/208 X |
| 4,487,011 | 12/1984 | Heinrich et al. | 57/246 |
| 4,534,165 | 8/1985 | Toshimasa et al. | 57/284 X |
| 4,539,805 | 9/1985 | Ukai et al. | 57/290 |
| 4,549,395 | 10/1985 | Dammann | 57/340 |
| 4,559,772 | 12/1985 | Heinrich et al. | 57/247 |
| 4,567,721 | 2/1986 | Kuroda | 57/284 |
| 4,682,465 | 7/1987 | Kojima et al. | 57/247 |
| 4,704,856 | 11/1987 | Nelson | 57/247 X |
| 4,788,816 | 12/1988 | Clements et al. | 57/208 |
| 4,969,322 | 11/1990 | Sasaki et al. | 57/245 X |
| 5,035,110 | 7/1991 | Nelson | 57/208 |
| 5,100,729 | 3/1992 | Jacob et al. | 57/247 X |

FOREIGN PATENT DOCUMENTS 0427805 5/1994 European Pat. Off. .

OTHER PUBLICATIONS

DIN 53 840, Nov. 1983, Bestimmung von Kraueselkennwerten an texturierten Filamentgarnen, Parts 1 & 2, pp. 213–222.

Klaus Fisscher, "Ein Beitrag Zur Torsions–und Streck–Texturierung", Nov. 27, 1978, pp. 120–121.

*Primary Examiner*—William Stryjewski

*Attorney, Agent, or Firm*—Michael J. Striker

[57] ABSTRACT

The friction texturized polyester filament yarn has a titer of 400 to 600 dtex and a crimpability of at least 45% and can be provided with at least 60 slubs/m. The method of making this friction texturized polyester filament yarn comprises texturizing a flat yarn with a titer of 400 to 600 dtex at a rate of at least 350 m/min and a yarn tension ratio, F2/F1, less than one via a squeezing twister. A set yarn can be made from the friction texturized polyester yarn with the titer of 400 to 600 dtex by heating.

9 Claims, 2 Drawing Sheets

METHOD OF PRODUCING A FRICTION TEXTURIZED POLYESTER FILAMENT YARN AND YARN MADE THEREBY

BACKGROUND OF THE INVENTION

The following application is a continuation-in-part of U.S. patent application Ser. No. 07/613,776, filed Nov. 16, 1990, now abandoned.

The present invention relates to a method of making a friction texturized polyester filament yarn and to an improved yarn made by that method.

Friction texturized polyester yarns having a titre of up to 250 dtex and a usable crimp and methods of making them are known. Friction texturized polyester yarns having a titre of 330 dtex have also been made, but they do not have a satisfactory crimp. This type of yarn can be used only to a limited extent in the production of set yarn.

A long standing need exists for texturizing polyester yarn having a coarse titer of greater than 330 dtex. One skilled in the art knows that up to now yarn having a titre in excess of 250 dtex can only be obtained by the friction method in which a considerable amount of crimp is lost, since the twisting momentum that can be transferred to the yarn by conventional friction disk units is so limited that the yarn twist required to obtain proper crimp cannot be obtained. Accordingly, one skilled in the art uses texturizing machines to only texturize yarn having a titre from less than 250 dtex to 330 dtex.

Up to now yarn with coarse texturized yarn titres has been produced by plying fine yarns. This entails loss of capacity according to the number of plied fine yarns, if the plying takes place on the texturizing machine, or the need for a separate process.

SUMMARY OF THE INVENTION

It is an object of the present invention to provide a friction texturized polyester yarn with a coarse titre, particularly from 400 to 600 dtex, and a good crimpability with a plying process.

It is another object of the present invention to provide a method of making a friction texturized polyester yarn with a coarse titre of 400 to 600 dtex with a crimpability of at least 45%.

According to the invention, the above objects are attained in a friction texturized polyester filament yarn having a titre of 400 to 600 dtex and a crimpability of at least 45%.

This friction texturized polyester filament yarn can surprisingly be produced by a method including the step of texturizing a flat yarn with a titre of 400 to 600 dtex at a rate of at least 350 m/min and a yarn tension ratio, F2/F1, less than one via a squeezing twister to form the friction texturized polyester filament yarn having a titre of 400 to 600 dtex and the crimpability of at least 45%. The F2 and F1 are the yarn tensions in the yarn immediately downstream and upstream of the squeezing twister respectively.

In a preferred embodiment the friction texturized filament yarn can be provided with at least 60 slubs/m after interlacing so that a flawless processing into warp and weft is guaranteed.

A set yarn can be made from the friction texturized polyester filament yarn by heating, preferably at temperatures from 210° to 240° C. It can be provided with a crimp of less than or equal to 30%.

Surprisingly it is possible to make the coarse texturized polyester filament yarn of the invention with commercially available texturizing machines and utilize the full capacity of the commercial machines in a speed range in which it is possible to obtain an increase in throughput of up to 75% compared to the current plying methods.

In plying and twisting one or more filaments on a texturizing machine, one problem is caused by the unequal filament yarn tension which results in different filament lengths between the slubs, as a result of which, an irregular surface is formed in fabric made from the yarn. Apart from the increase in capacity, an additional advantage is the elimination of this source of defects, while the texturizing is simplified.

The method of the invention is characterized by the fact that it is now possible to draft coarse titres at a rate of at least 350 m/min with a yarn tension ratio less than 1, the yarn tension ratio being the ratio of the yarn tensions before and after the location of the squeezing twister.

The squeezing twister can comprise two cylindrical members extending longitudinally in the same direction as a portion of the flat yarn being twisted or rings. The cylindrical members or rings are positioned on each side of the yarn being twisted and rotate. They are then brought into contact with the yarn by air pressure so that the rotating members or rings twist the yarn.

To prepare the friction texturized filament yarn according to the invention as described above, a commercial friction twister machine can surprisingly still be used, but it is necessary to use a novel combination of air pressure and disc angle which is not disclosed in the prior art.

Coarse titre yarns made on an experimental basis with conventional disk friction units heretofor after further processing into fabric had regions had a shrinkage in width of up to 50% and hence were useless. The cause of this difficulty was established as the required high yarn tension after or downstream of the twister. However with squeezing friction twisters, the yarn tension downstream of the twister can be reduced to the extent that this disadvantageous result does not occur.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENTS

Figure 1:
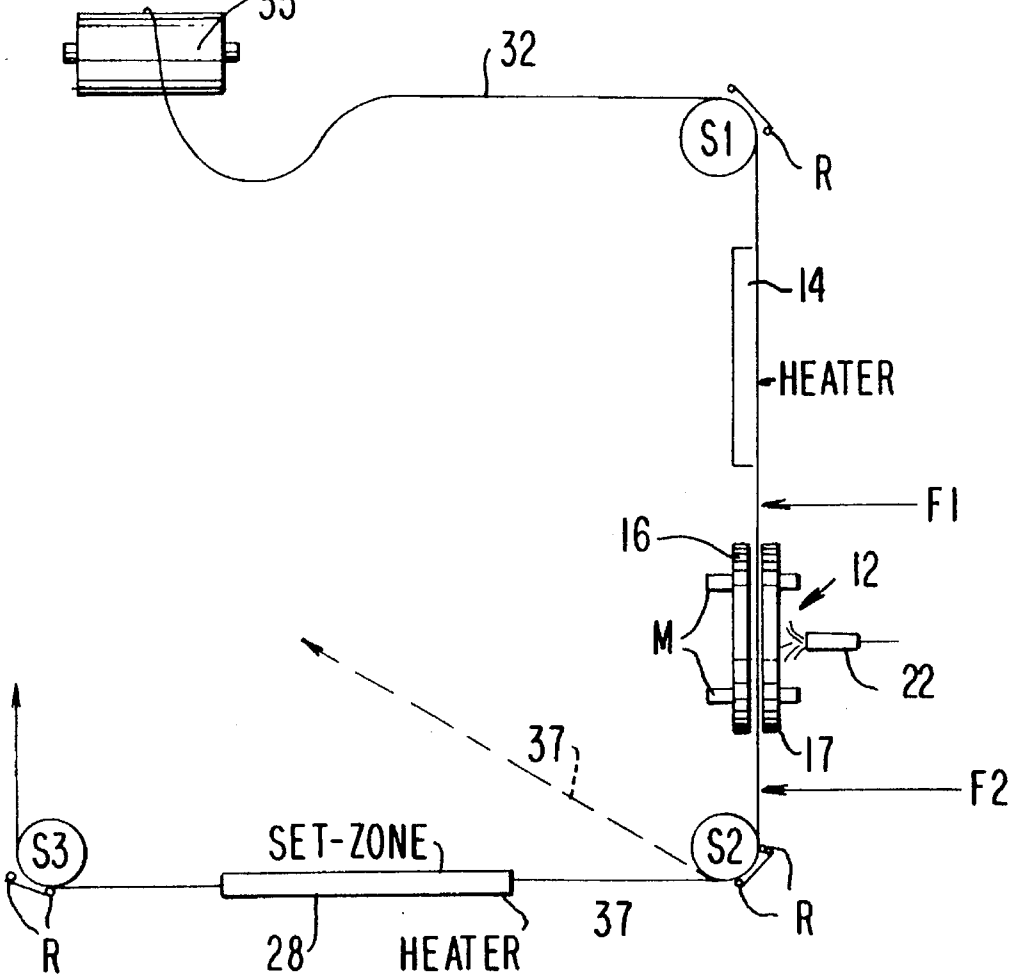
FIG. 1 is a schematic diagram of the basic elements of an apparatus performing the process according to the invention.

FIG. 1 shows the basic elements of an apparatus 10 for performing the method of the invention. This apparatus includes a squeezing twister 12 for twisting the yarn and a heater 14. The yarn 32 is fed from a supply bobbin 35 around a first shaft S1 through the heater 14 and then through the squeezing twister 12 where it is twisted upstream and detwisted downstream. In the preferred embodiment the yarn is advantageously a flat polyester filament yarn with at least 80% by weight of ethylene terephthalate units and a titre from 400 to 600 dtex. Then after passing through the squeezing twister 12 the detwisted yarn passed around a second shaft S2. After passing around the second shaft S2 the yarn is friction texturized polyester filament yarn 37 having a crimpability of at least 45%. The yarn is held against both shafts S1 and S2 by rollers R. The temperatures in the heater 14 are over 200° C., advantageously about 230° C.

Figure 2:
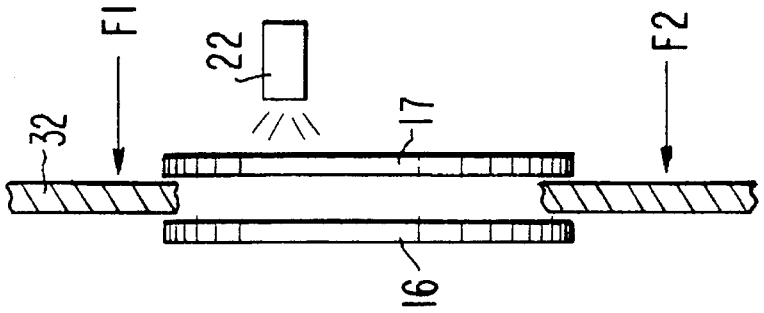
FIG. 2 is a detailed top plan view of a squeezing twister used in the apparatus of FIG. 1.

A preferred squeezing twister 12 is shown in more detail in FIG. 2. It comprises two rotating cylindrical members 16,17 on each side of the yarn 33. The multifilament yarn is twisted when the surfaces of the rotating cylindrical members 16,17 contact the side surfaces of the yarn 33. These rotating members are mounted so that they can be pushed against and from the yarn 33 as it rotates on a mounting means M. Also the contact or disk angle α with the yarn 33 can be changed. A means for supplying forced air 22 can be used to forced the rotating member 17 against the yarn 33. The pressure of the rotating member 17 can be controlled by controlling the means for supplying the air pressure 22.

Figure 3:
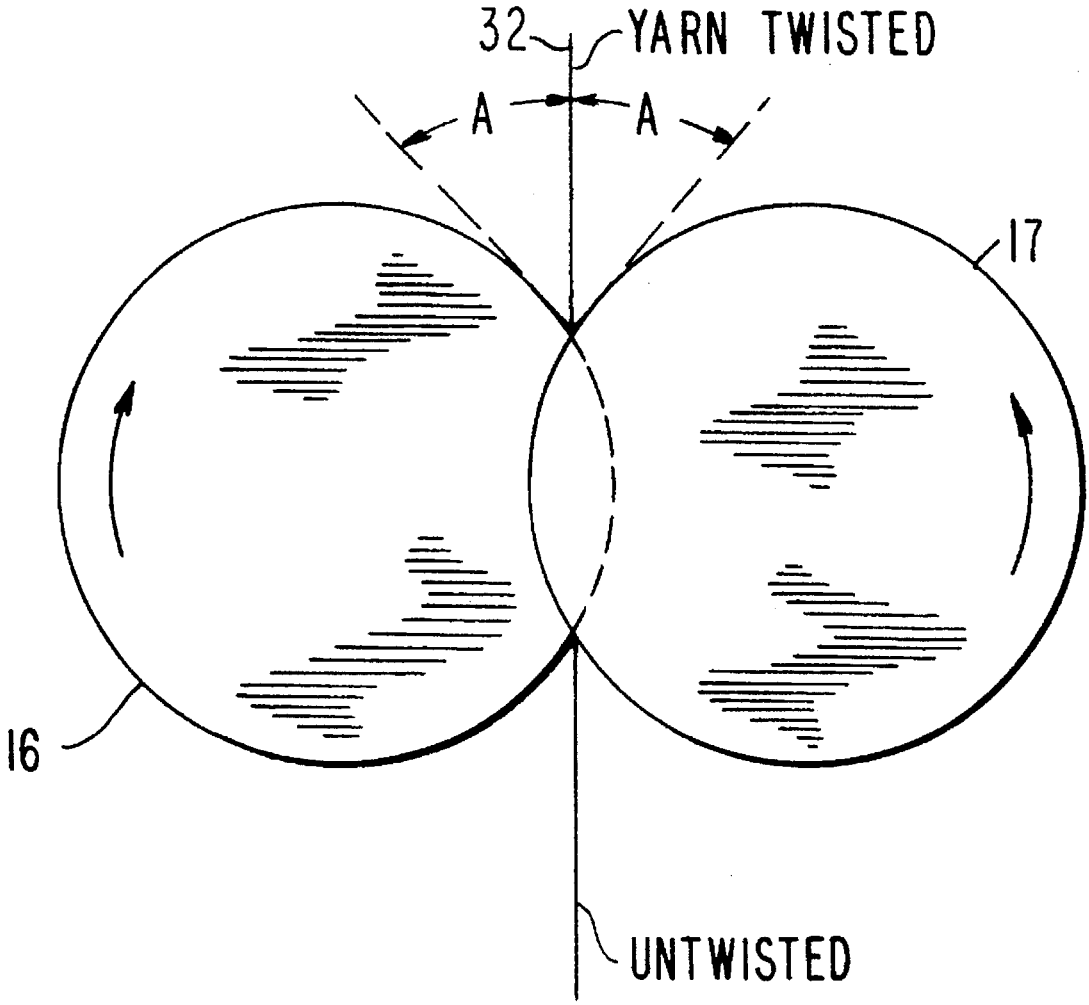
FIG. 3 is a schematic cross-sectional view through the squeezing twister shown in FIG. 2.

The desired friction texturized polyester filament yarn 37 can be obtained by controlling the process parameters including the disk angle α shown in FIG. 3 and the air pressure for the air supplied by the means for supplying the air pressure 22. It is essentially that the process parameters be controlled so that the ratio of the yarn tension immediately after or downstream of the squeezing twister 12 to that immediately before or upstream is less than one. That is, it is a required feature of the process according to the invention that the yarn tension F2 after the squeezing twister be always less than the yarn tension F1 before or upstream of the squeezing twister 12.

By feeding the friction texturized polyester filament yarn 37 through a set-zone heater 28 and subsequently around a third shaft S3 a set yarn can be produced. By controlling the heating conditions in the set-zone heater and speed ratio 28 a set yarn with a crimp of less than or equal to 30% can be obtained. The temperatures in the set-zone heater 28 are from 200° to 250° C., advantageously from 210° to 240° C.

FIG. 1 shows only the essential elements of the apparatus to perform the process of the invention. As squeezing friction twisters which can perform the process of the invention and contain these elements, various commercial machines can be used. These machines include the RINGTEX® device of Barmag AG(5630 Remscheid 11 Leverkuser Strasse 65 Federal Republic of Germany and the NIPTWISTER® of Murata Corp, Japan. Another suitable machine is that of RPR, Officine Meccaniche Riva. Product sheets of these corporation show that these machines are rated for use with flat yarn having a titre of less than 300 dtex. Thus it is surprising for one skilled in the art that the commercially available machines can perform the method.

The following Tables 1 and 2 show the settings for the RINGTEX and NIPTWISTER devices and the machines and the feed yarn properties for a polyester filament yarn with at least 80% by weight ethylene terephthalate units, which will produce the friction texturized polyester filament yarn 37. The precondition for a perfect yarn product which can be used to make a fabric which does not show shrinkage after washing is setting of the yarn tension ratio less than 1 as described above.

TABLE 1

MACHINE SETTINGS FOR RINGTEX SQUEEZING TWISTER

| Test No. | 1 | 2 | 3 | 4 |
|---|---|---|---|---|
| Titre, dtex | 330 | 330 | 500 | 500 |
| Ring speed/yarn speed | 1.5 | 1.42 | 1.59 | 1.55 |
| Air pressure, bar | 4.5 | 4.5 | 4.5 | 4.5 |
| Disk angle | 55 | 55 | 56.5 | 56.5 |
| Draw ratio | 1/1.7 | 1/1.7 | 1/1.65 | 1/1.66 |
| Heater 14, Temp, °C. | 230 | 230 | 230 | 230 |
| Overfeed in set-zone | −4.34 | −5.47 | −4.34 | −5.43 |
| Heater 28, Temp, °C. | 210 | 230 | 220 | 220 |
| Air pressure used, bar | 1.5 | 1.3 | 2 | 1.4 |
| Wind up % | −4.34 | −4.34 | −4.34 | −4.34 |
| Wind up speed, m/min | 431 | 431 | 339 | 339 |
| Final wind parameter | 6.1 | 6 | 5 | 5 |
| in motion, s | 8.5 | 7.1 | 8.6 | 8.6 |
| Disturbance +/− % | 1 | 1 | 1 | 1 |
| Upstroke, downstroke, s | 3.5/2.7 | 2.9/2.6 | 2.9 | 2.9 |
| Cross angle, ° | 27.4 | 30.2 | 29.6 | 29.6 |
| Double strokes, DH/min | 197.4 | 220 | 167.5 | 160 |

TABLE II

MACHINE SETTINGS FOR NIPTWISTER SQUEEZING TWISTER

| Test No. | 5 | 6 | 7 |
|---|---|---|---|
| Titre, dtex | 330 | 330 | 500 |
| Ring speed/yarn speed | 1.78 | 1.78 | 1.65 |
| Air pressure, bar | 1.1 | 1.0 | 1.1 |
| Belt angle | 125 | 125 | 125 |
| Draw ratio | 1/1.72 | 1/1.1 | 1/1.66 |
| Heater 14, Temp, °C. | 230 | 230 | 230 |
| Overfeed in set-zone | −6.45 | −6.45 | −3.29 |
| Heater 28, Temp, °C. | 240 | 230 | 240 |
| Air pressure used, bar | 1.5 | | 1.3 |
| Wind up % | −5.43 | −5.43 | −4.34 |
| Wind up speed, m/min | 473 | 379 | 335 |
| Final wind parameter | 6.8 | 5.4 | 7.2 |
| in motion, s | 8 | 9 | 7.2 |
| Disturbance +/− % | 1 | 0.9 | 0.9 |
| Upstroke, downstroke, s | 3 | 3.6 | 6.1 |
| Cross angle, ° | 31.6 | 26.6 | 32.4 |
| Double strokes, DH/min | 240 | 167. | 183 |

The results of the texturizing with these two machines are shown in the following table III.

TABLE III

TEXTURIZING RESULTS FOR RINGTEX AND NIPTWISTER MACHINES

| | TWISTER | | | | | | |
|---|---|---|---|---|---|---|---|
| | RINGTEX | | | | NIPTWISTER | | |
| Test No. | 3 | 4 | 2 | 1 | 7 | 6 | 5 |
| Titre, dtex | 552 | 545 | 369 | 370 | 553 | 358 | 374 |
| Elongation, % | 27.5 | 26 | 25 | 25.5 | 29.5 | 15.2 | 24.5 |
| Streng., cN/tex | 32.2 | 34 | 36 | 36.1 | 32.8 | 33.8 | 35.2 |
| Crimp % | 22.5 | 26.2 | 29 | 29.9 | 23.5 | 13.1 | 29.5 |
| Boil Shrink, % | 1.9 | 2.4 | 2 | 1.65 | 1.6 | 1.4 | 1.65 |
| Slubs/m | 92 | 95 | 86 | 67 | 88 | | 65 |

TABLE III-continued

| TEXTURIZING RESULTS FOR RINGTEX AND NIPTWISTER MACHINES | | | | | | | |
|---|---|---|---|---|---|---|---|
| | TWISTER | | | | | | |
| | RINGTEX | | | | NIPTWISTER | | |
| Test No. | 3 | 4 | 2 | 1 | 7 | 6 | 5 |
| Remission | | | | | | | |
| X value % | 66.7 | 66.9 | 68.9 | 66.7 | 67 | 67.1 | 67.2 |
| S % 1.23 | 0.67 | 0.99 | 1.0 | 1.11 | 0.7 | 0.5 | |
| V % 1.84 | 1.0 | 1.42 | 1.5 | 1.66 | 1.0 | 1.0 | |

The value of the remission is given by X, its standard deviation by S and its coefficient variation by V. The crimp values were determined by Texturmat. The coarse titres show a distinctly coarser crimp structure and thus lower crimp values. Almost the same crimp values are obtained as with an input filament yarn with dtex 167.

In accordance with the invention it is possible for the first time to texture even polyester filament yarns with titres up to 600 dtex with the squeezing twisters at a reduced (adjusted) speed (because of heat transfers) without any distinct decline in crimp values as compared with plied yarns.

The texturizing rate for these titres is so high that it would need to be 50% higher for single yarns to be plied to achieve the same throughput per machine.

Although the invention has been illustrated and described as embodied in a method of producing a friction texturized polyester filament yarn and yarn made thereby, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

I claim:

1. Method of making friction texturized polyester filament yarn, said method comprising the step of texturizing a flat yarn with a titre of 400 to 600 dtex at a rate of at least 350 m/min and a yarn tension ratio, F2/F1, less than one via a squeezing twister to form a friction texturized polyester filament yarn having a titre of 400 to 600 dtex and a crimpability of at least 45%, wherein said F2 and said F1 are yarn tensions in said yarn immediately downstream and upstream of said squeezing twister respectively.

2. Method of making a set yarn comprising the steps of:

a) texturizing a flat yarn with a titre of 400 to 600 dtex at a rate of at least 350 m/min and a yarn tension ratio, F2/F1, less than one via a squeezing twister to form a friction texturized polyester filament yarn having a titre of 400 to 600 dtex and a crimpability of at least 45%, wherein said F2 and said F1 are yarn tensions in said yarn immediately downstream and upstream of said squeezing twister respectively, and b) heating said friction texturized polyester filament yarn having said titre of 400 to 600 dtex and said crimpability of at least 45% to form a set yarn of 400 to 600 dtex titre and a crimp of from 22.5 to 29.9%.

3. Method as defined in claim 2, wherein said heating of said friction texturized polyester filament yarn is performed at a temperature of from 210° to 240° C.

4. Method as defined in claim 2, wherein said crimp of said set yarn is 29%.

5. Method as defined in claim 2, wherein said crimp of said set yarn is 29.9%.

6. Method as defined in claim 2, wherein said crimp of said set yarn is 29.5%.

7. Method as defined in claim 2, wherein said crimp of said set yarn is 26.2%.

8. Method as defined in claim 2, wherein said crimp of said set yarn is 23.5%.

9. Method as defined in claim 2, wherein said crimp of said set yarn is 22.5%.

* * * * *